United States Patent [19]

Temelli

[11] Patent Number: 4,610,209

[45] Date of Patent: Sep. 9, 1986

[54] GRATE BAR AND GRATE TUMBLER FOR THE TUMBLER GRATE OF, E.G., A TRASH INCINERATION INSTALLATION OR THE LIKE

[75] Inventor: Sedat Temelli, Erkrath, Fed. Rep. of Germany

[73] Assignee: Mullverbrennungsanlage Wuppertal GmbH, Fed. Rep. of Germany

[21] Appl. No.: 675,888

[22] Filed: Nov. 28, 1984

[30] Foreign Application Priority Data

Dec. 23, 1983 [DE] Fed. Rep. of Germany ..... 3346747
May 29, 1984 [DE] Fed. Rep. of Germany ..... 3420020

[51] Int. Cl.[4] ..... F23K 3/18

[52] U.S. Cl. ..... 110/276; 126/167; 126/168; 126/179

[58] Field of Search ..... 110/275, 276; 126/167, 126/168, 179; 198/780; 414/159

[56] References Cited

U.S. PATENT DOCUMENTS 1,961,098 5/1934 Denker ..... 110/276
2,501,763 3/1950 Denker et al. ..... 110/276
3,078,839 2/1963 Mitchell et al. ..... 126/167

FOREIGN PATENT DOCUMENTS 35644 2/1926 Denmark ..... 126/167

*Primary Examiner*—Edward G. Favors
*Attorney, Agent, or Firm*—Jones & Askew

[57] ABSTRACT

The invention concerns a grate bar for a grate tumbler of a tumbler grate of a trash incineration installation or similar combustion facility with a base rod showing an outer rod surface and an inner rod surface, as well as side surfaces, a head surface and a foot surface, the cross-section form being T-shaped with a cross rod (15). The invention also concerns a grate tumbler for the tumbler grate of a trash incineration installation or the like with a hollow shaft and a cylindrical carrier construction, with grate-bar carriers resting upon the carrier construction and grate bars mounted upon the carriers, while the grate bars are mounted upon the grate bar carriers (8) in such fashion that the slit (25) between adjacent grate bars (11) is no greater than 1 mm in width on the combustion-chamber side.

12 Claims, 6 Drawing Figures

GRATE BAR AND GRATE TUMBLER FOR THE TUMBLER GRATE OF, E.G., A TRASH INCINERATION INSTALLATION OR THE LIKE

The invention concerns a grate bar and a grate tumbler equipped with grate bars for the tumbler grate of a trash incineration installation or similar combustion facility.

A trash incineration installation in which the invention can be utilized includes a feeder device with a back-and-forth stoker for pushing the trash through a feed-shaft opening into the combustion chamber. In the combustion chamber the trash is subjected to an intensely glowing flame. Within the combustion chamber and behind the feeder device there is a tumbler grate, which is designed as a sloping grate of five or six grate tumblers, each about 1.5 m in diameter, sloped sequentially along a plane of about 30° inferior to the direction of feed so that so-called pockets are formed between the tumblers.

The most important constructional features of these grate tumblers are, as a rule, a hollow shaft anchored at both ends and a cylindrical support construction with radial walls bearing the axially extended grate-bar supports upon which the curved grate bars of cast grate iron are arranged in parallel and sequential rows in such a fashion that slits remain open between adjacent bars. The grate bars form the jacket, or the so-called grate lining, of the grate tumbler. As a result of the rotation of the grate tumbler, the grate bars are exposed only intermittently to the effect of the fire and can cool down again in the air zones. Between the grate tumblers there are guide walls which seal off the tumblers and, in conjunction with these tumblers, form pockets during the combustion of the trash.

The tumbler grate is enclosed in a sheet-metal housing with compartments for each grate tumbler. Air is introduced laterally into these zones in regulated quantities. The air should pass from these zones, through the grate lining and the bed of combustible trash, and into the combustion chamber.

Drying and ignition of the readily combustible components have already begun before the trash reaches the tumbler grate. Due to the back-and-forth movement of the stoker, the trash falls as a thin sheet or lump with minimal mass into the pocket formed by the first guide wall and the first grate tumbler. Here the trash accumulates and sinks toward the bottom of the packet until such time as the slowly rotating grate tumbler carries material adhering to its surface back up out of the pocket. This material then moves over the grate tumbler into the second pocket between the first and second tumblers. This process is repeated from tumbler to tumbler and results in an intense turning of the trash to produce a good basic fire.

The distribution of air is adjusted to this combustion pattern by means of adjustable air underjets. Air introduction is minimal in the drying and ignition zone. It reaches its maximum input in the zone of primary combustion and tapers off to its lowest level in the burnoff zone.

It has been shown that the increased proportions of plastics, white metals, roofing felts, fats and similar materials, due to the fact that these substances are burned within the interior of the tumblers, cause the formation of deposits in the so-called tumbler baskets and in the grate ash funnels resulting in cloggings between the tumbler bars and blockage of the grate ash funnels. The grate tumber is designed so that the quantity of air necessary for combustion is passed through the tumbler basket, between the grate bars, and to the material lying on the tumbler for burning. Nevertheless, this constructively designed process is hampered by the deposits and cloggings in the tumbler basket. Furthermore, it cannot be ruled out that the plastics, fats, oils or the like may accumulate in concentrated form on a tumbler and reach the tumbler basket in a state of only partial combustion by passing through the still unclogged grate slits and continuing to burn in the tumbler basket. This can result in the danger of the tumbler itself beginning to burn. Tumbler cleaning operations have already revealed that the greater portion of the tumbler basket was burned away.

The grate bars of known grate tumblers consist of a relatively thin rod, which in a side view is curved and provided with two lateral surfaces, a head and a foot surface, as well as in outer rod surface on the fire side and an inner rod surface inside the tumbler. In the vicinity of the outer rod surface there are protruding, coglike projections from each side surface arranged at regular intervals parallel to the direction of the axis of the grate tumbler, so that each projection from one side surface is positioned diagonally to the projection from the opposing side surface and the projections of one grate bar extend into the spaces between the projections of a laterally adjacent grate bar leading a slit about 5 mm wide between adjacent grate bars. This slit—as already described—is intended for the introduction of air. The head and foot surfaces of the grate bars are so designed that they can be circumferentially and securely positioned in sequence onto the grate bar carrier.

Despite the fact that the form of the familiar grate bars is relatively complicated, it precludes the slits between adjacent grate bars from being designed to be appreciably narrower. On the other hand, the width of the slit is responsible for the fact that relatively fluid, still unburned trash components can pass through the slits into the interior of the tumbler resulting in the adverse effects already described.

It is the goal of the invention to devise a means whereby the penetration of relatively fluid products from the trash to be incinerated can be prevented.

The invention is exemplarily explained in detail below with regard to the preferred embodiment depicted in the drawings.

Figure 1:
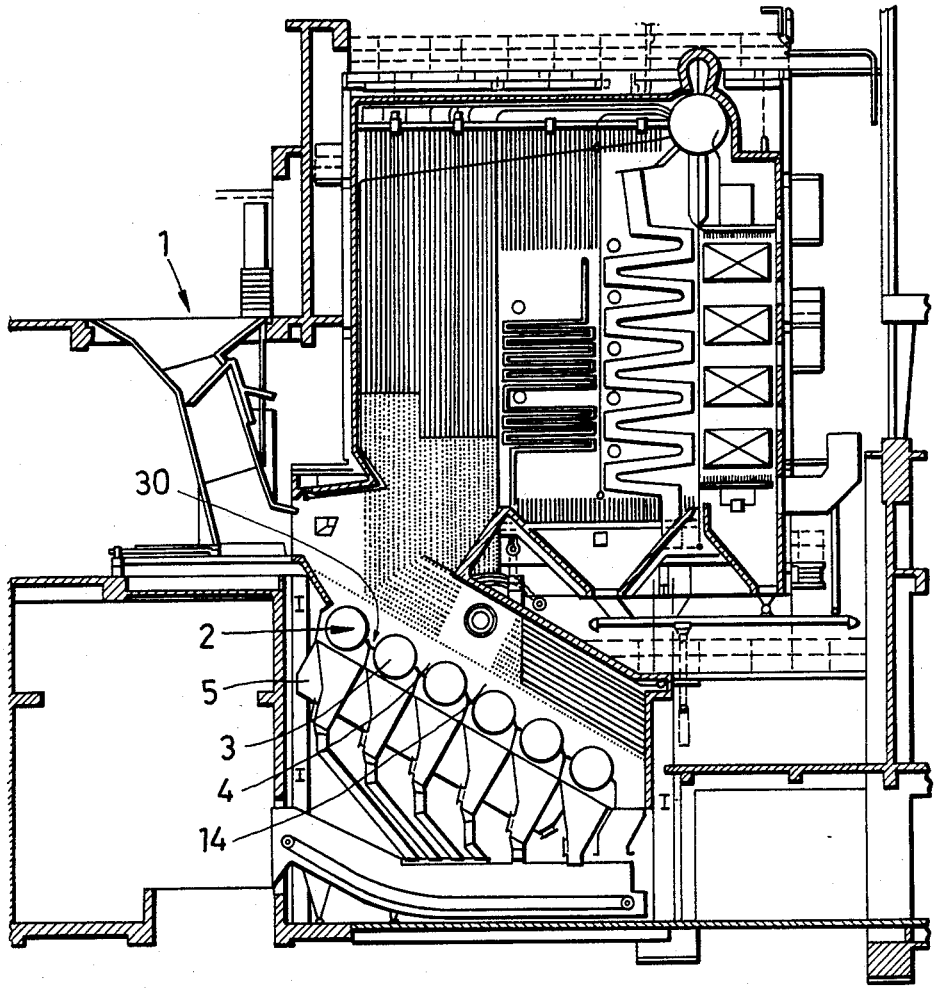
FIG. 1 is a schematic view of a trash incineration installation according to a preferred embodiment of the present invention.
Figure 2:
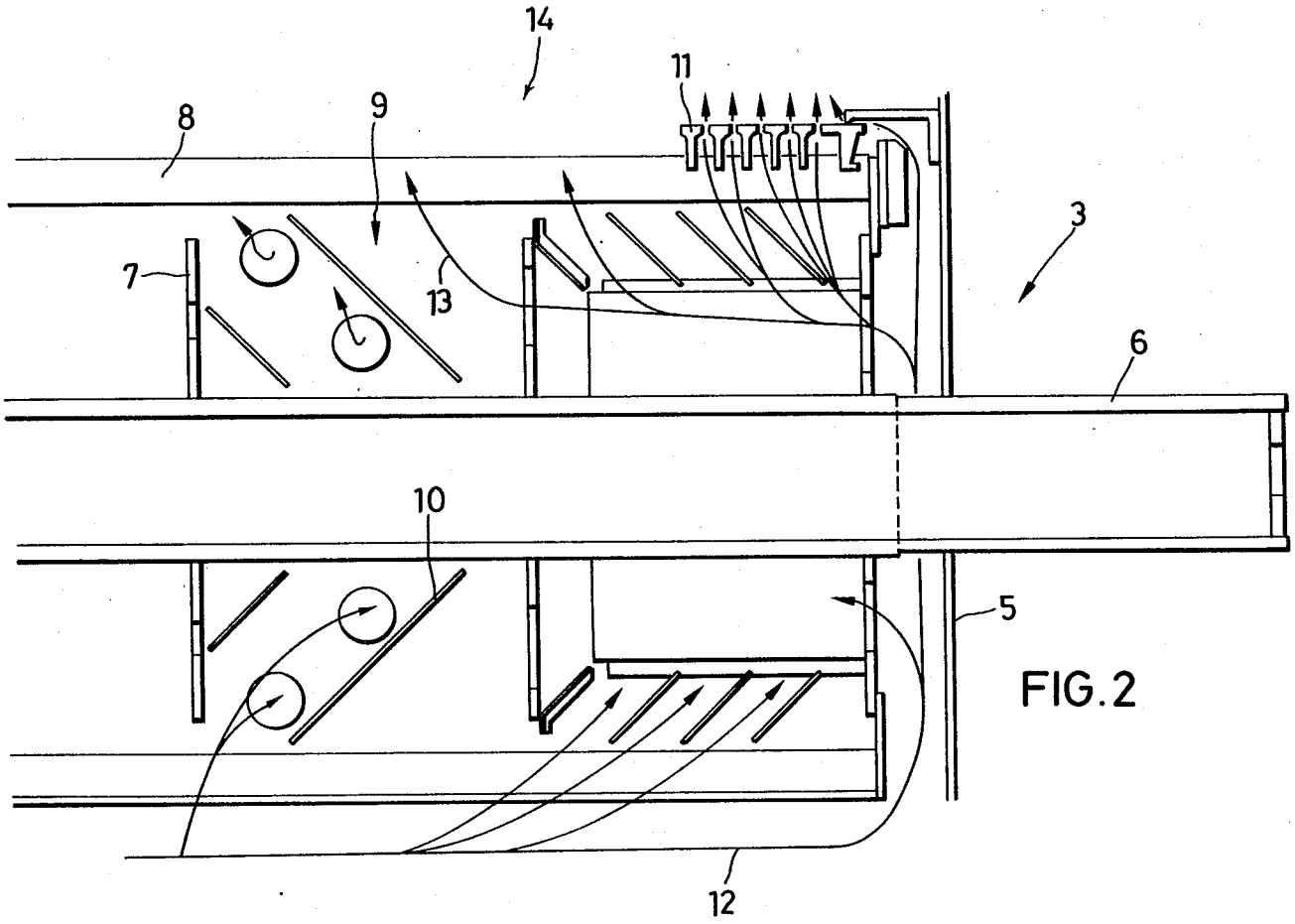
FIG. 2 is a section view showing a schematic of a grate tumbler in the preferred embodiment.

The trash incineration installation in FIG. 1 shows a stoker device (1) by means of which the trash (not depicted) is fed onto the tumbler grate (2) sloped in the direction of movement. The tumbler grate (2) consists of several rotatable grate tumblers (3) arranged alongside each other across the direction of movement, so that pockets (4) are formed between adjacent grate tumblers. The tumbler grate (2) is enclosed in a sheet-metal housing (5) with partitions for each grate tumbler. Air is introduced into these zones in regulated quantities. Since none of the other elements of the trash incineration installation are involved in the invention, they are not further described here—being already known. Each grate tumbler (3) is laterally anchored in the sheet-metal housing (5) by means of a hollow shaft (6) (FIG. 2). The cylindrical carrier construction of the grate tumbler is borne between the anchorings. It consists primarily of radially extended walls or support flanges (7) arranged at intervals along the hollow shaft; the axially extended grate bar carriers (8) rest upon these flanges at intervals along the inner periphery of the tumbler. Between the flanges (7), tumbler baskets (9) are formed, in which a feature of the invention, namely an air guide plate (10), is affixed obliquely to the longitudinal axis of the tumbler. Grate bars (11) are positioned along the grate bar carriers (8). The lines (12) and arrows (13) in FIG. 2 indicate the air passage followed by the air from the sheet-metal housing (5), through the grate tumbler (3), and into the combustion chamber (14). The other elements of a grate tumbler are not germane to the invention and are not included in this description.

Figure 4:
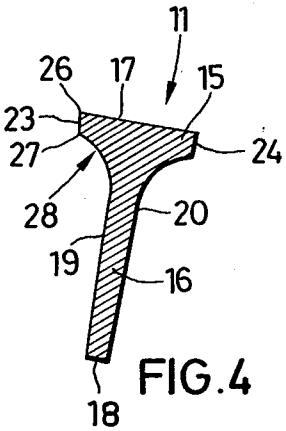
FIG. 4 is a cross section along line A-B in FIG. 3.
Figure 3:
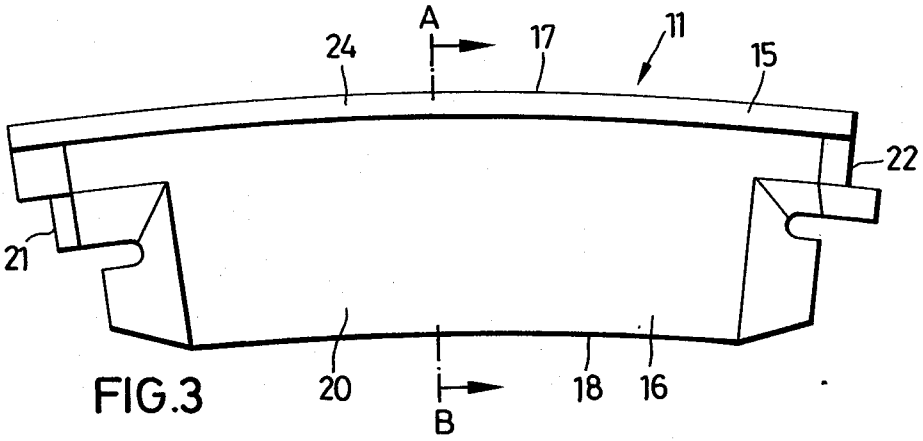
FIG. 3 is a side view of a grate bar in the grate tumbler.

A grate bar in keeping with the invention is shown in cross section (FIG. 4) to be essentially T-shaped and to consist of a cross rod (15) and a base rod (16). The illustration shows the outer rod surface (17) and the inner rod surface (18), as well as the side surfaces (19) and (20), the head surface (21) and the foot surface (22), the cross rod being provided with side-cant surfaces (23) and (24). The design of the head and foot surfaces is familiar and not germane to the invention; consequently, it is not further discussed.

What is important is that the side-cant surfaces (23) and (24) are flat and, when viewed in cross section (FIG. 4), are inclined inward from the combustion-chamber corner (26) to the inner corner (27) in the direction of the base rod (16). This results in the formation of wedge-shaped, jet-like slits (25) which taper toward the combustion chamber (FIG. 5) between any two laterally adjacent grate bars.

It is also important that the corners (26) of the cross rods (15), shown in the illustration as being of straight configuration, can be set very close to the adjacent grate bars. Accordingly, a grate tumbler in keeping with the invention is characterized by being equipped with the grate bars of the invention with the slit (25) between adjacent grate bars being ca. 2 mm wide, preferably 1 mm or less, at the corners (26) on the combustion-chamber side. It can also be advantageous if the individual tumblers have variable slit widths in relation to their location within the combustion zone, since the slag is normally at its most fluid state in this location and, consequently, the greatest danger exists there that the fluid slag can run into the interior space. Tumblers with greater slit widths are advantageous for the manufacturer, since they can be produced with greater tolerances.

Figure 5:
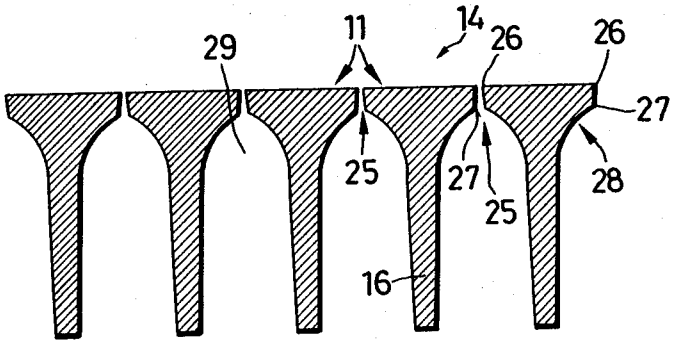
FIG. 5 is a laterial and sequential schematic arrangement of grate bars.

In addition, it is especially advantageous that the side surfaces (19) and (20) in the upper third lead to corner (27) in a curve (28), which results in the formation of a sort of pointed arch (29) between adjacent grate bars (FIG. 5). It is furthermore advantageous that the base rod (16) be tapered uniformly toward the top, so that the widening can extend without a curve to the corner (27). These latter characteristics reinforce the effectiveness of the slits (25).

With the newly developed form of the grate tumbler bars, the primary introduction of air can take place through the 2 mm wide and narrower grate slits (25). Thereby the drop-through of white metals and plastics or the like into the interior space of the tumbler is precluded. The jet-like slit (25) increases the speed of the air, especially in conjunction with the arched form (29), so that provision is made that the grate tumbler slits (25) remain open during operation for the injection of primary air, which is one of the most important physical components for combustion. An even distribution of the combustion air over the entire grate surface of the individual tumblers is insured by the invention. Slit widths equal to or less than 1 mm are especially effective, due to the surface tension of molten white metals, in precluding the drop-through of these melts. In keeping with the invention, a certain rate of flow is attained which prevents the fluid slag from clogging the grate or penetrating into the tumbler. This rate of flow is definitively associated with the relation of the slit width to the interval between the base rods (16). A ratio of 1/25 to 1/50 [slit width/interval] is meaningful here.

The form of the new grate bars makes higher surface pressures possible, thus minimizing the danger of breakage of a grate bar. Defective bars are known to block the tumblers and result in an emergency shut-down of an installation, which leads to extensive and expensive disadvantages. The width of the cross rod (1) is preferably 40 to 48 mm, the width of the base rod (16) ca. 18 mm, with emphasis on 20 to 25 slits per meter of the tumbler length.

The cleaning intervals prescribed by the manufacturer are about 4000 hours. With the new grate tumbler, self-cleaning by primary air injection occurs. The previous cleaning time, which experience has shown to require some 250 hours per tumbler, can be dispensed with.

Figure 6:
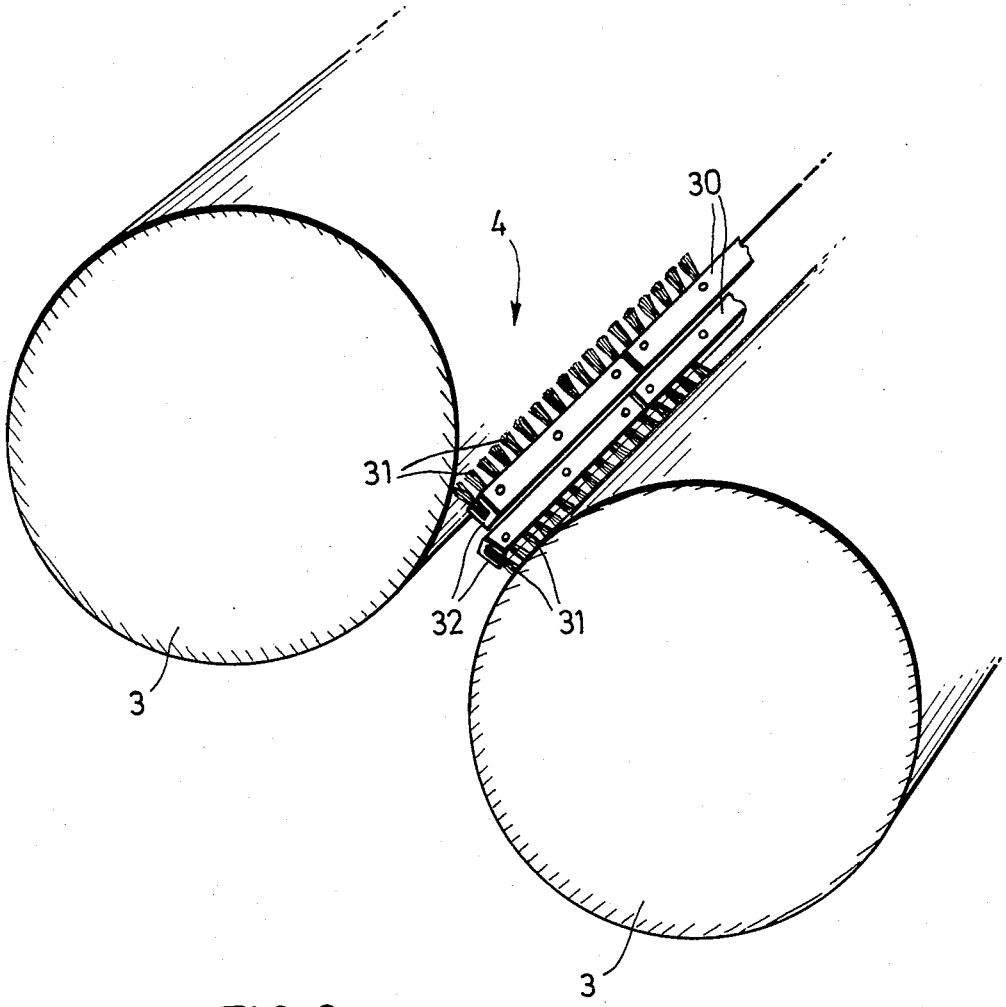
FIG. 6 is a view of a tumbler with scraper, in accordance with the preferred embodiment of the invention.

As particularly illustrated in FIG. 6, scrapers (30) made up of steel bristles (31) affixed alongside each other in a clamp track (32) are positioned in the pockets (4) between each two adjacent tumblers (3). The length of the scraper is the same as that of the tumbler. The distance between the bristles (31) is preferably 10 to 15 mm, and the circumference is ideally 20 to 25 mm. The distance between the free ends of the bristles and the surface of the tumbler is about 10 to 15 mm. The advantage of the bristle scraper over the familiar scraper made of sheet metal is represented by the flexibility attained, inasmuch as it is now practically impossible for a foreign body to become lodged in the space between the tumbler and the scraper. This results in maximum avoidance of damages to the tumbler grate bars and the tumbler drive mechanism. In addition, the greater penetrability of the bristles results in improved ventilation of the narrowed space between the tumblers.

Thus, the invention moves in a direction counter to the current stage of the art. The teachings up to now have demanded the widest slits possible between the grate bars in order that sufficient air could be introducted. In keeping with the invention, the slits are narrowed, while the form of the grate bars insures that the primary air is forced through the slits at a high velocity so that over long periods of time no materials from the trash can make their way through the slits into the interior of the tumbler and the slits themselves are prevented from becoming clogged.

I claim:

1. In a grate tumbler for the tumbler grate of a trash incineration installation or the like, having a long axis with a hollow shaft and a cylindrical carrier construction, with grate-bar carriers resting upon the carrier construction upon which grate bars are mounted, the improvement comprising:

the grate bars being mounted upon the grate-bar carriers and comprising a base rod having an outer rod surface facing a combustion chamber of the incineration facility, an inner rod surface, side surfaces, a head surface, and a foot surface;

each grate bar having a cross rod located at an end of the base rod in proximate location to the combustion chamber so that the cross-section form of the grate bar is a T-shape; and adjacent ones of said grate bars being mounted in parallel spaced apart relation so as to define a slit between said cross rods of adjoining grate bars, the slit between adjoining grate bars being not more than substantially 2 mm wide on the combustion-chamber side.

2. The grate tumbler according to claim 1, characterized by the slit width being less than or equal to 1 mm.

3. The grate tumbler according to claim 1, characterized by air guide plates being positioned in the carrier construction obliquely to the long axis of the tumbler, so as to direct a flow of air through said slits and into the combustion chamber.

4. The grate tumber according to claim 1, characterized by said slit formed between adjacent grate bars being wedge shaped in cross section to define a jet narrowing toward the combustion chamber, so as to increase the speed of air through the slits to the combustion chamber and thereby prevent the slits from clogging.

5. The grate tumbler according to claim 4, characterized by a pointed arch-shaped air injection space situated before the wedge-shaped slit.

6. The grate tumbler according to claim 4, characterized by the ratio of the slit width to the interval between the base rods being 1/25 to 1/50.

7. The grate tumbler according to claim 1, characterized by twenty to twenty-five slits per meter of tumber length.

8. The grate tumbler according to claim 1, characterized by scrapers disposed adjacent each tumbler and formed of individual steel bristles.

9. An elongate grate bar for use in a tumbler grate located in a combustion chamber of an incinerator and having a plurality of such grate bars mounted in spaced-apart parallel juxtaposition so as to define a continuous elongated slit between adjacent grate bars, comprising:

an elongated base rod having an outer rod side facing the combustion chamber, and also having an inner rod surface and side surfaces along the length of the elongated base rod;

said outer rod side comprising an elongated cross rod joined to the base rod so that the cross section form along the length of the elongate grate bar is a continuous T-shape;

said cross rod having an outer rod surface facing the combustion chamber, so that the contiuous elongated slit between adjacent grate bars is defined between the elongated cross rods of said grate bars;

said outer rod surface having outer corners extending lengthwise and facing the combustion chamber; and said cross rod having flat side-cant surfaces positioned proximately at a right angle to said outer corners and having inner corners running parallel to each other.

10. The grate bar according to claim 9, wherein:

said side-cant surfaces have lengthwise inner corners joining said side surfaces and said inner surface; and said side-cant surfaces being flat and slanted from said combustion-chamber corners to said inner corner distant from the combustion chamber in the direction of the base rod, so that the elongated slit between adjacent grate bars is wedge-shaped in cross section to define a jet narrowing toward the combustion chamber, thereby increasing the speed of air flowing between the slits to the combustion chamber and preventing the slits from clogging.

11. The grate bar according to claim 9, wherein:

the side surfaces of the base rod are curved in the upper third toward said cross rod, with an arch leading to said inner corner, so that the space between confronting curved side surfaces of adjacent elongate grate bars defines a pointed arch between the adjacent grate bars.

12. The grate bar according to claim 11, characterized by the base rod widening uniformly upwards toward said cross rod.

* * * * *